US005396852A

United States Patent [19]

Bardsley

[11] Patent Number: 5,396,852

[45] Date of Patent: Mar. 14, 1995

[54] TURING MACHNINE MODULAR GAUGE PARTS

[75] Inventor: Harold B. Bardsley, Euxton, United Kingdom

[73] Assignee: Spencer Wright Industries, Inc., Dalton, Ga.

[21] Appl. No.: 173,572

[22] Filed: Dec. 27, 1993

[30] Foreign Application Priority Data

Jan. 7, 1993 [GB] United Kingdom ..... 9300219
Apr. 2, 1993 [GB] United Kingdom ..... 9306924

[51] Int. Cl.[6] ..... B05C 15/08
[52] U.S. Cl. ..... 112/80.45
[58] Field of Search ..... 112/80.45, 226, 163, 112/80.4, 80.01; 66/207, 208, 114; 19/129 R, 113, 114; 403/375, 387

[56] References Cited

U.S. PATENT DOCUMENTS 4,637,329 1/1987 Czelusniak, Jr. ..... 112/80.45
4,835,989 6/1989 Hall et al. ..... 66/207 X
5,295,450 3/1994 Neely ..... 112/80.45

*Primary Examiner*—Clifford D. Crowder
*Assistant Examiner*—Paul C. Lewis
*Attorney, Agent, or Firm*—Alan Ruderman

[57] ABSTRACT

A tufting machine having spaced apart needle modules removably mounted on a needle bar in the tufting machine, the modules having notches at opposite side edges remote from the needles. Each side edge is of a generally half U-shape configuration so that when two modules are mounted side-by-side a substantially U-shape recess is formed at the abutting sides. A clamping plate is secured by a fastener extending through each recess to clamp against the pair of adjacent modules. A cut-out at a central portion of each module at the edge remote from the needles receives a locating member which is adjustably secured to the needle bar, the locating member abutting the edges of the cut-out to precisely locate each module. In another embodiment, a tab formed as part of a gauging bar is temporarily positioned within the recess to locate modules not having the central cut-out. Removal of a module merely requires loosening of the fasteners to permit the module to be slidably retracted, and a replacement module may thereafter be precisely inserted.

15 Claims, 2 Drawing Sheets

TURING MACHNINE MODULAR GAUGE PARTS

BACKGROUND OF THE INVENTION

This invention relates to tufting machines and more particularly to tufting machine modular gauge parts having a construction which facilitates accurate and rapid location and positioning in the tufting machine and minimizes the tendency of a module to twist due to the forces applied during the tufting process.

In tufting machines a plurality of yarn carrying needles are mounted on needle bars extending transversely across the machine, the needle bars being reciprocated cyclically so that the needles penetrate and insert loops of yarn into a backing material fed through the machine. The loops formed are seized by either loopers or hooks mounted on a looper or hook bar depending upon whether it is desired to produce loop pile or cut pile in the material, and in the latter case loops seized by the hooks are cut by knives cooperating with the hooks. In the tufting art the gauge of a pile fabric is determined by the spacing between adjacent parts, i.e., the needles, loopers or hooks, and knives, of the tufting machine, such parts being known as gauge parts. The spacing between the needles, known as the pitch, is a measure of the gauge of the pile fabric produced. The needles and the loopers or hooks must be accurately positioned so that cooperation therebetween results in a loop being seized by the looper or hook. The term looper is used in the art in conjunction with uncut pile while the term hook is used in the art in conjunction with cut pile and those instances where both cut and uncut loops are formed. Thus, for convenience the term hook will be used hereinafter, it being understood to apply to hooks and loopers.

In fine gauge machines, i.e., those which produce fabric that have tufts which are closely spaced apart such as 0.1 inch or smaller, in order to increase the ease with which a faulty or damaged needle or hook can be replaced and to ensure that the requisite spacing is maintained either initially or during replacement of a damaged needle or hook, it has become common for small groups of needles or hooks to be mounted on a needle or hook module, such needle modules being illustrated, for example, in Parsons U.S. Pat. No. 4,138,956. A number of such modules may be removably mounted on the needle or hook bar in side-by-side disposition to form rows of needles or hooks on the needle or hook bar respectively. The removal and replacement of needle or hook modules necessitates that the new module or modules be positioned accurately on the respective needle or hook bar to ensure accurate cooperation with the corresponding gauge parts.

Conventionally a single central screw, as illustrated in the aforesaid Parsons patent, acts to secure such modules to the respective bar. Such a securing, however, renders it difficult to ensure accurate replacement of a damaged or worn module or modules and furthermore necessitates entire removal of the central screw from each module to be replaced. Additionally, the use of a central screw does not preclude a twisting about the screw when large forces are applied to the gauge parts and this can affect the accuracy of the cooperation between the needles and hooks. Another type of needle module in which a pair of spaced apart screws are received through bores in a flange beneath the needle bar and threadily received within the needle bar is disclosed in Czelusniak U.S. Pat. No. 4,574,716, but such an arrangement requires removal of both the screws in order to replace a single module and, additionally, since the screw holes may not be precisely drilled, location is not precise.

SUMMARY OF THE INVENTION

Consequently, it is a primary object of the present invention to provide a module of tufting machine gauge parts which may be removably positioned easily and conveniently on the supporting bar in a tufting machine.

It is another object of the present invention to provide a gauge parts module having locating means for locating the module on a supporting bar in a tufting machine and having securing means for securing the module to the bar.

It is a further object of the present invention to provide a tufting machine needle module having a plurality of needles, the module having a body including an edge from which the needles extend, the body having a cut-out at each end at an edge remote from the needles to form a recess between adjacent modules for receiving securing means for clamping adjacent modules together to the needle bar.

It is a still further object of the present invention to provide a tufting machine needle module having a plurality of needles, the modules having a body including an edge from which the needles extend, the body having a cut-out at each end at an edge remote from the needles to form a recess between adjacent modules for receiving securing means for clamping adjacent modules to the needle bar, and having a further cutout for receiving a locating member to identify precisely the position of the module on the needle bar.

It is a yet still further object of the present invention to provide a tufting machine needle module having a plurality of needles, the module having a body including an edge from which the needles extend, the body having a cut-out at each end at an edge remote from the needles to form a recess between adjacent needles for receiving securing means for clamping adjacent needles to the needle bar, and having a locating member which may be inserted selectively into the recess to identify precisely the position of the module of the needle bar.

Accordingly, the present invention provides a module carrying a plurality of spaced apart gauge parts such as needles, the module being removably mounted on a support bar such as a needle bar and having portions at opposite side edges removed for receiving fastening means including bearing members for bearing against respective adjacent modules for removably securing the module to the needle bar. This permits the modules to be easily and conveniently removed and replaced in position on the needle bar. The module also includes locating means for precisely positioning the module and replacement modules on the needle bar for accurate cooperation of the needles with the corresponding hooks.

The removed portions comprise a notch preferably of a generally half U-shape so that the removed portion of two adjacent modules have a substantially U-shaped recess at abutting sides. A clamping plate secured by fastener means bears against pairs of adjacent modules to secure the modules to the needle bar, the fastener means being received through the combined recess. To remove a module, it is not necessary to remove the fastener means, the fastener means merely being loosened to an extent permitting removal of the modules.

The locating means may comprise removable tabs which are received within the recesses, but preferably comprise a locating member positionable within a cut-out at a central portion of the module at the edge remote from the needles, the locating member being adjustably secured to the needle bar and acting with the cut-out to precisely position a module so that the needles cooperate properly with the corresponding hooks.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 1:
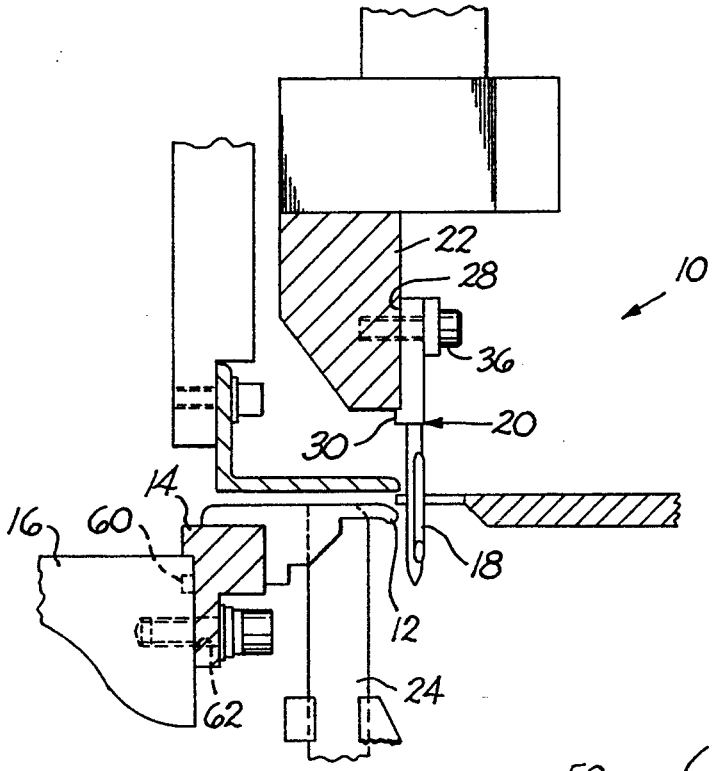
FIG. 1 is a diagrammatic side elevational view of a portion of a tufting machine embodying the principles of the present invention.

Referring now to the drawings, and particularly to FIG. 1, a tufting machine 10 includes a hook 12 carried by the body 14 of a hook module secured to a hook bar 16 for oscillation toward and away from a needle 18. The needle 18 is formed as part of a needle module 20 which is secured to a needle bar 22 for reciprocation in the axial direction of the needle in conventional manner. The hook 12 may cooperate with a knife 24 which oscillates in timed relationship therewith for cutting a loop of yarn seized by the hook from the needle to form cut pile. Each needle module 20 includes a body member 26 into which a plurality of needles 18 are molded, as now well known in the art.

Each body member 26 has a substantially rectangular form including a substantially planar rear face 28 except for the lower portion which includes a flange 30 which extends rearwardly to abut the lower edge of the needle bar to provide a vertical positioning of the modules. Each body member 26 of each module has a notch 32 cut-out at each of the opposite lateral sides at the end thereof remote from the end from which the needles extend. Each notch has a generally half U-shaped configuration and when the modules are mounted on the needle bar 22 with each side of a module abutting an adjacent module, a substantially U-shape recess 34 is formed between the abutting modules. Each module 20 is removably secured to the needle bar 22 by inserting two fasteners, such as screws 36, through bearing plates 38, such as washers, enlarged heads of the screws, or the like, and through the recess 34 on each side of the module into threaded cooperation with corresponding tapped bores 40 in the needle bar 22. When the fasteners 36 are threadedly tightened into the threaded bores 40, the clamping plates 38 forcibly bear against the front face of the body member 26 of the module thereby securing the modules defining the U-shape recess to the needle bar 22.

It will be appreciated that the fact that the modules 20 are held in place by fasteners and bearing plates which bear against the opposite side of the module results in increased stability of the module 20 during operation of the tufting machine relative to prior art modules secured by a single central screw which have a tendency to twist about the central screw when any significant force is applied to the needle at an angle to the direction of reciprocation, e.g., when passing through backing material into which the loops are tufted. A further advantage of the securing of the modules bearing against the sides thereof is that a module 20 may be removed from the tufting machine without removal of the screw 36 or bearing plates 38, it only being necessary to loosen the fasteners to an extent sufficient to allow a module 20 to be slidably retracted and removed. Additionally, the particular side-to-side disposition of the module 20 in combination with securing by bearing on the module at the sides increases the combined stiffness or rigidity of the group of modules and the needle bar 22 transversely, i.e., along the axis of the needle bar.

Figure 4:
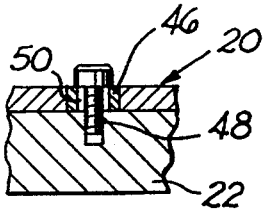
FIG. 4 is a cross sectional view taken substantially along line 4—4 of FIG. 2.
Figure 2:
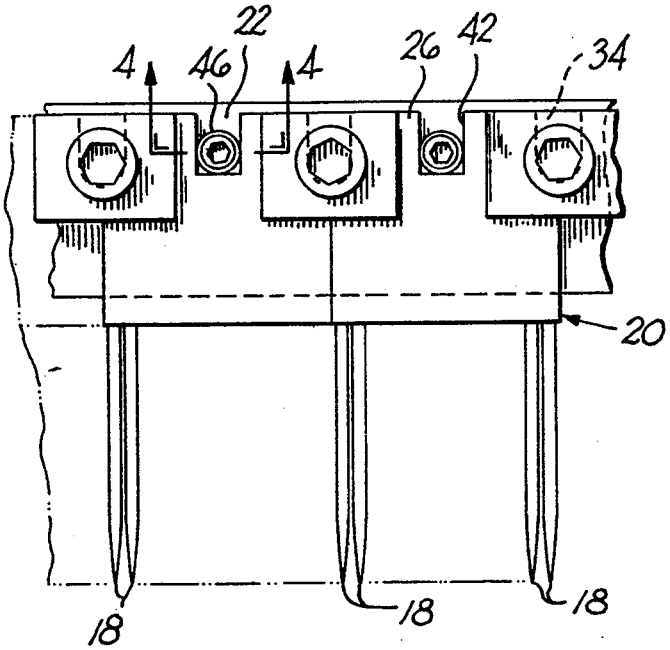
FIG. 2 is a front elevational view of a portion of the tufting machine depicted in FIG. 1 illustrating the preferred form of a needle module constructed in accordance with the present invention.
Figure 3:
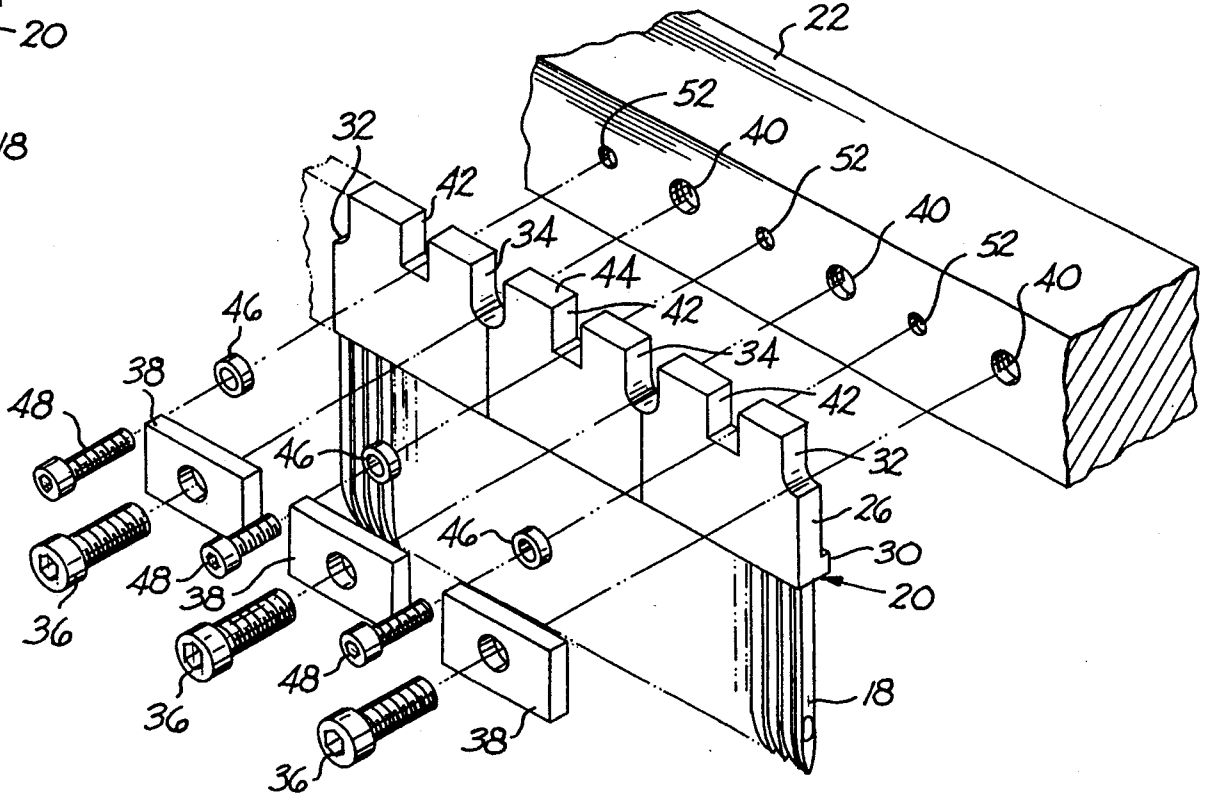
FIG. 3 is an exploded perspective view of the structure illustrated in FIG. 2.

In the embodiment of the invention illustrated in FIGS. 2 through 4, there is provided an additional cut-out 42 generally at the center of the top edge 44 of the module, i.e., the edge remote from the edge from which the needles extend, the cut-out 42 being any convenient shape such as U-shape or rectangular as illustrated. The cut-out 42 of the module 20 cooperates with a locator member which may be a rectangular plate or preferably a cylindrical member 46 which is removably secured to the needle bar 22 by fasteners, such as screws 48 which extend through a central enlarged aperture 50 of the member 46 into threaded engagement with a tapped hole 52 in the needle bar 22. The enlarged aperture 50 in the locator member 46 permits lateral, i.e., side-wise adjustment of the locator member 46 relative to the screw 48.

In use, once the needle modules have been mounted on the needle bar to ensure accurate cooperation of the needles with the hooks of the tufting machine during operation, the position of the module 20 will be precisely identified on the needle bar by removably securing the locator member 46 to the needle bar 22 in such a position that it cooperates and abuts the lateral side edges of the cut-out 42, i.e., with the legs of the U-shape or rectangular configuration of the cut-out. Thus, when a module 20 is required to be removed for replacement or repair, the accurate replacement of the module on the needle bar 22 can be ensured, it being simply a matter of locating the cut-out 42 of the module 20 in cooperation with the locator member 46 secured to the needle bar so as to ensure accurate location.

It will be appreciated that the locator members 46 may be provided in a cut-out 42 in one of every few modules since the manufacturing tolerances of the modules 20 may be such that accurate position will not be lost over the extent of a single or a few modules. However, it is expected that a locator member 42 may be used for each module.

Figure 5:
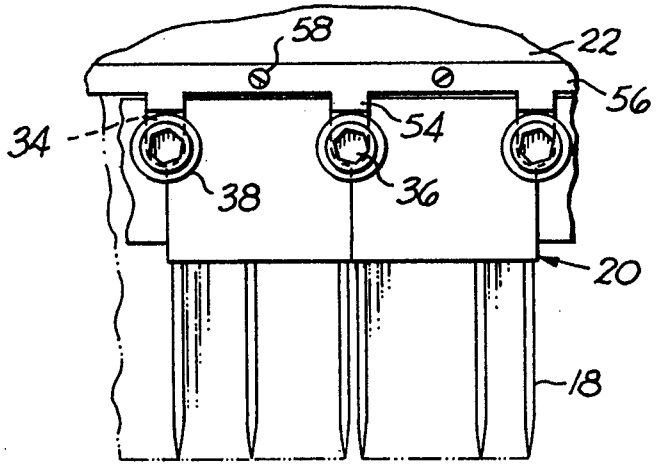
FIG. 5 is a view similar to FIG. 2 of a needle module constructed in accordance with a second embodiment of the present invention.

In the embodiment illustrated in FIG. 5 rather than the locator members 46, accurate replacement of modules 20 or groups of modules may be provided by a locating tab 54 which may be inserted into the recess 34 between the modules to identify precisely the position on the needle bar 22 of a particular module 20, the tab 54 having side edges conforming substantially in size to the spacing between the legs of the U-shape recess. The locating tab 54 may be formed on a gauging bar 56 temporarily secured to the needle bar above the modules by a suitable removable securing means such as screws 58. The tab 54 may then provide a means for accurately positioning the modules 20. Again it will be appreciated that it may not be necessary to provide a locating tab 54 in each recess 34 since the manufacturing tolerances of the modules may be such that accurate position may not be lost over the extent of a single module, and accordingly it is believed that it may only be necessary to provide locating tabs every few modules, e.g., four to ten modules to ensure accuracy to the desired degree.

The hook module 14 may also be easily and accurately gauged to the hook bar 16 by incorporating a locating member 60 at a rear face of the hook module, i.e., the face where the module abuts the hook bar, as illustrated in FIG. 1. The locating member 60 may be a cylindrical button preferably formed integral with the hook module above the hole 62 through which the module securing screw 64 is received.

Accordingly, needle and hook modules may be removably positioned and replaced accurately, easily and conveniently on a respective needle bar or hook bar in a tufting machine.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufting needle module for a tufting machine comprising a body member having a substantially rectangular configuration including front and rear longitudinally extending surfaces terminating at spaced apart side edges, a plurality of similarly disposed elongated needles in the body member having point portions depending from one end thereof, said needles being equally spaced apart longitudinally along the body member, the spacing between adjacent needles defining the pitch of the needles of said module, a notch formed on each longitudinally spaced apart side edge at an end remote from the end from which said needles depend, each notch forming half of a recess when a like module is positioned in abutment with each side edge, each said recess permitting a fastener to enter intermediate a pair of module body members for attachment of said modules to a tufting machine needle bar.

2. A module as recited in claim 1, wherein said body member includes an opening formed intermediate said notches at said end remote from the end from which said needles depend for receiving a locating member for locating said module on a needle bar.

3. A module as recited in claim 1, wherein said notch has a substantially half U-shape configuration, whereby said recess has a substantially U-shape configuration.

4. A module as recited in claim 2, wherein said opening has a substantially U-shape configuration.

5. A module as recited in claim 4, wherein said notch has a substantially half U-shape configuration, whereby said recess has a substantially U-shape configuration.

6. In a tufting machine having a needle bar and a plurality of needle modules mounted on said needle bar in side-by-side disposition, each module comprising a body member having a substantially rectangular configuration including front and rear longitudinally extending surfaces terminating at spaced apart side edges, a plurality of similarly disposed elongated needles formed in the body member having point portions depending from one end thereof, said needles being equally spaced apart longitudinally along the body member, the spacing between adjacent needles defining the pitch of the needles of said module, said modules being disposed with said rear surface abutting said needle bar, a notch formed in each module in each longitudinally spaced apart side edge at an end remote from the end from which said needles depend, each notch forming half of a recess when another module is positioned in abutment with each side edge, a bearing member abutting the front surface of the body member of each adjacent pair of modules at the location of each recess, and fastener means positioned within each recess for securing each bearing member to said needle bar in bearing relationship against said front surface of the body members of said pair of modules.

7. In a tufting machine as recited in claim 6, wherein said notch has a substantially half U-shape configuration, whereby said recess has a substantially U-shape configuration.

8. In a tufting machine as recited in claim 6, wherein each body member includes an opening formed intermediate said notches at said end remote from the end from which said needles extend, a locating member disposed in said opening, and means for securing said locating member to said needle bar.

9. In a tufting machine as recited in claim 8, wherein said opening has a substantially U-shape configuration.

10. In a tufting machine as recited in claim 9, wherein said notch has a substantially half U-shape configuration, whereby said recess has a substantially U-shape configuration.

11. In a tufting machine as recited in claim 8, wherein said opening has a substantially U-shape configuration including a pair of spaced apart legs, and said locating member is disposed in said opening in abutting relationship with both of said legs.

12. In a tufting machine as recited in claim 11, wherein said locating member is adjustably secured to said needle bar lengthwise relative to said modules.

13. In a tufting machine as recited in claim 6, including a locating tab positionable within said recess for locating said modules relative to said needle bar.

14. In a tufting machine as recited in claim 13, wherein each recess has a substantially U-shape configuration including a pair of spaced apart legs, and said tab abuts both legs.

15. In a tufting machine as recited in claim 14, wherein said locating tab is temporarily positionable in said recess, and removable after said modules are located on said needle bar.

* * * * *